US006314855B1

(12) United States Patent
Uhlenhuth et al.

(10) Patent No.: US 6,314,855 B1
(45) Date of Patent: Nov. 13, 2001

(54) CABLE WITH A CABLE CORE, A CABLE JACKET AND A TEAR THREAD

(75) Inventors: Guenther Uhlenhuth, Roedental; Oliver Buechner, Neustadt, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/458,472

(22) Filed: Dec. 9, 1999

(30) Foreign Application Priority Data

Dec. 9, 1998 (DE) ..... 198 56 814

(51) Int. Cl.[7] ..... D04C 1/06
(52) U.S. Cl. ..... 87/7; 87/9; 57/210
(58) Field of Search ..... 57/200, 210, 212, 57/216, 218, 220, 224, 229, 230, 3, 293; 428/377; 87/1, 5, 7, 8, 9, 12, 13; 385/103, 106, 107, 113

(56) References Cited

U.S. PATENT DOCUMENTS 1,686,098 * 10/1928 Meiwald ..... 87/7
2,087,303 * 7/1937 Rosch et al. ..... 87/7
2,450,429 * 10/1948 Henning ..... 87/7
3,106,815 * 10/1963 Nance et al. ..... 87/7
4,059,951 * 11/1977 Roe ..... 57/230
4,299,884 * 11/1981 Payen ..... 428/377
4,445,321 * 5/1984 Hutchinson ..... 57/223
5,013,127 * 5/1991 Bernard ..... 385/107
5,109,457 * 4/1992 Panuska et al. ..... 385/102
5,197,370 * 3/1993 Gladfelter ..... 87/7
5,642,452 * 6/1997 Gravely et al. ..... 385/113
5,671,649 * 9/1997 Piotrowski et al. ..... 87/9
5,744,206 * 4/1998 Russek et al. ..... 428/36.3
5,896,482 * 4/1999 Blee et al. ..... 385/107
6,185,351 * 2/2001 Daneshvar et al. ..... 385/114

FOREIGN PATENT DOCUMENTS 91 13 530 4/1993 (DE) .
WO 92/10840 6/1992 (WO) .

* cited by examiner

*Primary Examiner*—Danny Worrell
(74) *Attorney, Agent, or Firm*—Alston & Bird LLP

(57) ABSTRACT

A cable with a cable core, a cable jacket and at least one tear thread extending therebetween, which tear thread is held in a fixed position by means of at least one auxiliary thread which is preferably wrapped or looped around the tear thread.

20 Claims, 2 Drawing Sheets

CABLE WITH A CABLE CORE, A CABLE JACKET AND A TEAR THREAD

BACKGROUND OF THE INVENTION

The present invention is concerned with a cable with a cable core, a cable jacket and at least one tear thread present between the core and the jacket. Such cables are widely used in order to facilitate stripping, i.e., in order to part or remove a layer of the cable more easily, for example, the outer coating, without damaging layers that are situated beneath this coating.

Given specific applications, an exact positioning of the tear thread is desirable, wherein the position can be made visible for the installer by means of marking the outside covering or jacket. However, it becomes clear than an exact positioning is difficult and can get lost given processing steps during manufacture. This problem is particularly present when a steel grooved jacket is used. For example when a cable that contains a steel grooved jacket with two tear threads is to be manufactured, the tear threads should preferably lie opposite one another. An approach in order to oppose the above-mentioned problem is to introduce a multitude of tear threads, so that at least two tear threads are opposite one another or, respectively, at least one tear thread is presented in the desired position or location.

Given cables with tear threads having a small length, another problem occurs. In a cable of a small length, it is frequently the case that the tear threads are pulled out of the cable without parting, tearing or breaking the cable jacket.

SUMMARY OF THE INVENTION

The present invention is directed to an object of providing a cable wherein the movement of one or more tear threads is inhibited or prevented. Another object of the invention is to provide a method for manufacturing such a cable.

These objects are achieved by a cable having a cable core, a cable jacket and at least one tear thread positioned between the core and the jacket, wherein the tear thread is fixed in position by means of at least one auxiliary thread. The method of the present invention comprises the steps of providing a cable core, arranging at least one tear thread on the cable core and arranging at least one auxiliary thread in order to fix the tear thread on the core and then arranging a cable jacket that surrounds the cable core, the tear thread and the auxiliary thread.

Given the inventive cable, the at least one tear thread is fixed in position by means of at least one auxiliary thread. Therefore, the tear thread cannot move out of the imagined position, either during the process of manufacturing the cable or given a post-processing, such as laying the cable or installation of the cable in cable ducts.

Advantageously, the inventive cable comprises a plurality of tear threads, in particular at least two tear threads. For example, individual layers of the cable can be parted independently of each other and can be parted following one another by the utilization of a plurality of tear threads. Alternatively, the utilization of a plurality of tear threads enables the parting of the cable layer, for example enables the parting of the coating at a plurality of positions.

Given the utilization of a plurality of tear threads, these are preferably equidistantly arranged around the cable core in a preferred embodiment of the inventive cable. For example, when two threads are present for parting the outside coating, these should lie diametrically opposite one another.

Preferably, the tear thread is wrapped by one or more auxiliary thread in order to achieve a particularly firm fixing and position. Not only an axial movement, but also a radial movement of the tear thread is inhibited by the wrapping, which, as warranted, can be supported by a knotting or tying.

Advantageously, the auxiliary thread or threads form a braid or a weave which preferably is what is referred to as a KEMAFIL type, which is described in a publication "Sonderdruck aus Band- und Flechtindustrie 30 (1993, 4–10, 76–81, 31 (1994)), 48–52". A more uniform total appearance of the cable can be simply achieved when the auxiliary threads are presented in such a form. Furthermore, a displacement of the auxiliary threads can also be avoided.

Finally, it is preferred that the tear threads are a part of the above-mentioned braid or weave and, in particular, extend parallel to the longitudinal axis of the cable.

At least one tear thread is arranged at the cable core in the inventive method for the manufacturing of such a cable. Thus, it should be understood that the cable core is an arbitrary structure which, for example, can be comprised of a plurality of layers. This particularly means that also an inventive cable can be understood as a cable core. At the same time or subsequent to the arrangement of at least one tear thread at the cable core, the tear thread is fixed in position with an auxiliary thread. Finally, a cable coating is arranged, which cable coating surrounds the cable core, the tear threads and the auxiliary thread. Thus, the inventive cable is manufactured with the inventive method.

Advantageously, a plurality of tear threads, particularly two tear threads, are arranged in order to individually successively part a plurality of layers of the cable or in order to part a layer at a plurality of positions.

Preferably, the auxiliary thread at least partially wraps the tear thread in order to guarantee an increased fixing of the tear thread given this arrangement. This wrapping can additionally comprise a knotting or looping and can comprise a multiple wrapping.

Given a preferred method, the tear thread and the auxiliary thread, essentially at the same time, are arranged as a braid or woven fabric. The arrangement advantageously occurs according to the known KEMAFIL technology, whereby the tear thread or the tear threads are integrated into a structure that is being formed.

Finally, it is preferred that the two tear threads and the two auxiliary threads, essentially according to the KEMAFIL technology, are knitted around the cable core so that the tear threads extend parallel to the longitudinal axis of the cable and are fixed in position by the auxiliary threads by means of this wrapping.

The auxiliary thread preferably exhibits less resistance to tearing than the tear threads in order not to impair the function of the tear threads. Given pulling of the tear threads, this means that the coating arranged thereupon is parted at the same time with the auxiliary threads. Therefore, a means is provided with the inventive method and the inventive cable in order to avoid an offset of the tear threads. Particularly, an exact positioning of the tear threads can be simply achieved and maintained given the process of manufacture, the post-processing and also the laying or installing of the cables.

Other advantages and features of the invention will be readily apparent from the following description of the preferred embodiments, the drawings and claims.

DESCRIPTION OF THE PREFERRED EMBODIMENTS

Figure 1:
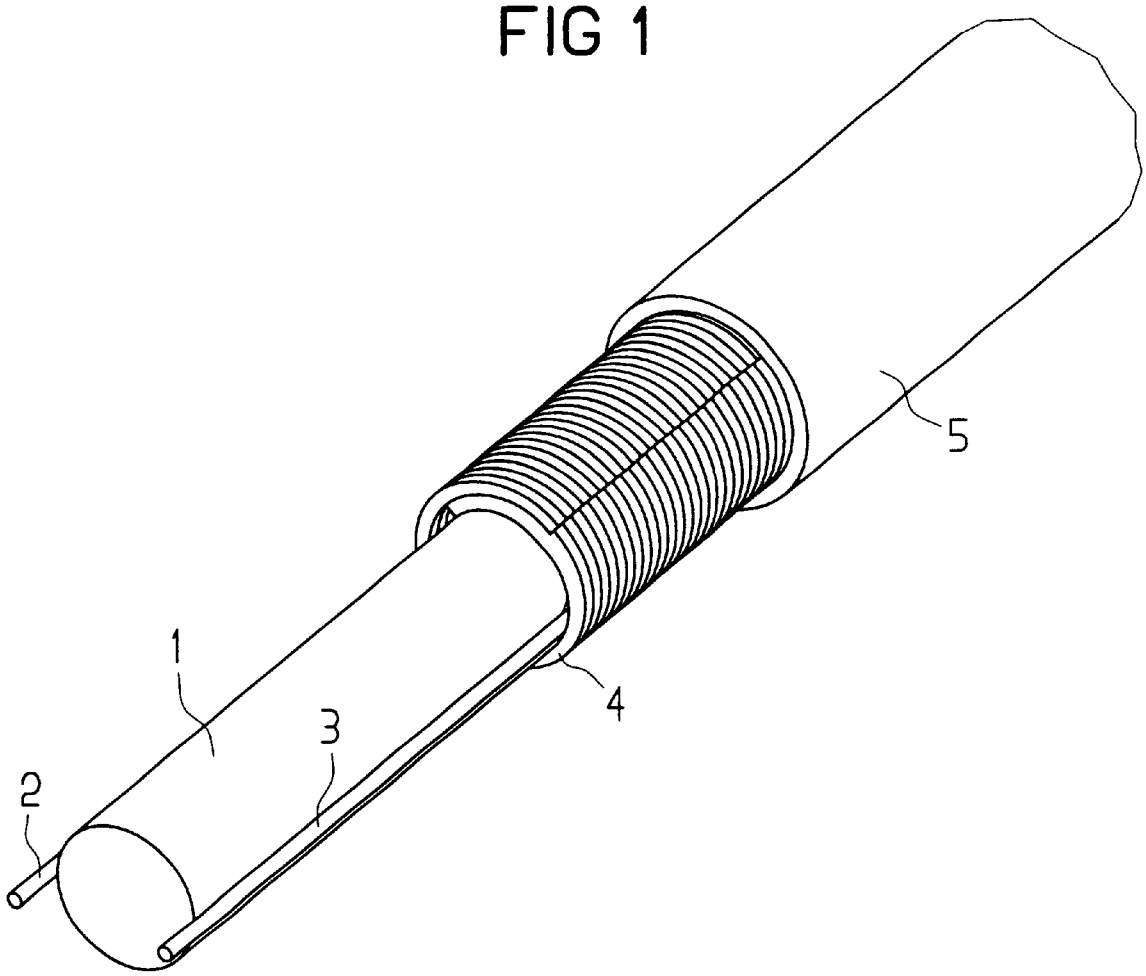
FIG. 1 is a perspective view of a cable with two tear threads in the desired arrangement.

The principles of the present invention are particularly useful when incorporated in a cable shown in FIG. 1, which has a cable core 1, a cable jacket formed by two layers 4 and 5 and at least two tear threads 2 and 3 which extend between the core 1 and the jacket. In this embodiment, the layer 4 of the cable jacket comprises a steel grooved jacket and the layer 5 is a plastic coating. As shown, the tear threads 2 and 3 should be present in an equidistant fashion with respect to the cable core 1, and this means that they lie diametrically opposite one another.

Figure 2:
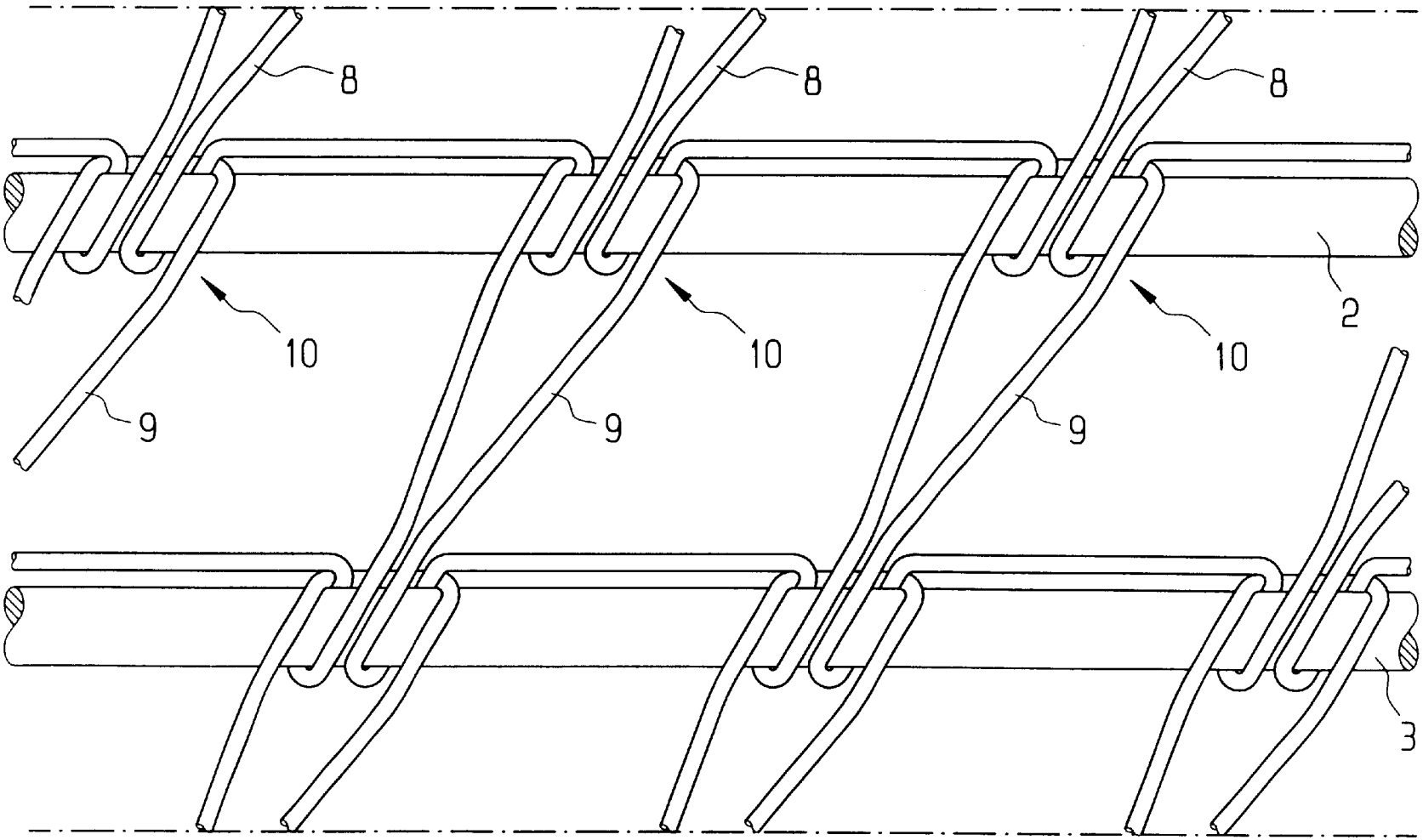
FIG. 2 is an arrangement of tear threads and auxiliary threads in a woven pattern which is in an unwound condition to illustrate the loop or tying of the threads by the auxiliary threads.

The tear threads 2 and 3 are wrapped with auxiliary threads, such as 8 and 9 (see FIG. 2), in order to guarantee the positioning shown in FIG. 1 of the two tear threads. FIG. 2 shows a weaving according to the KEMAFIL technology, wherein the tear threads 2 and 3 are components of the weaving. The significantly thinner auxiliary threads 8 and 9 are knitted with the tear threads 2 and 3 so that the tear threads 2 and 3 can no longer move. In the shown embodiment, the auxiliary threads 8 and 9, respectively, form a looping knot, as shown with the reference character 10.

Although the invention was completely and exemplarily described above with reference to the enclosed drawings, someone skilled in the art should recognize that different modifications are possible and are to be included in the scope of the claimed invention. Exemplary different wrappings and looping techniques can be used. In addition, the fabric does not have to be of the KEMAFIL type. Finally, it is also not necessary to integrate the tear threads into the fabric, since it would be sufficient for the fixing at a cable core when the auxiliary thread is arranged over the tear threads as a fixing layer.

Although various minor modifications may be suggested by those versed in the art, it should be understood that we wish to embody within the scope of the patent granted heron all such modifications as reasonably and properly come within the scope of our contribution to the art.

We claim:

1. A cable with a cable core, a cable jacket and at least one tear thread extending therebetween, the improvement comprising the tear thread being fixed in position by means of at least one auxiliary thread, wherein two tear threads are wrapped by at least one auxiliary thread, and wherein the auxiliary threads are provided as a braid with the two tear threads extending along the longitudinal axis of the cable.

2. A cable with a cable core, a cable jacket and at least one tear thread extending therebetween, the improvement comprising the tear thread being fixed in position by means of at least one auxiliary thread, wherein the at least one auxiliary thread has a lower resistance to tearing than the at least one tear thread.

3. A cable with a cable core, a cable jacket and at least one tear thread extending therebetween, the improvement comprising the tear thread being fixed in position by means of at least one auxiliary thread, wherein the auxiliary threads are provided as a braid or a weave.

4. A cable with a cable core, a cable jacket and at least one tear thread extending therebetween, the improvement comprising the tear thread being fixed in position by means of at least one auxiliary thread, wherein the tear thread is wrapped by said at least one auxiliary thread, and wherein the auxiliary thread is provided as a braid.

5. A method for manufacturing a cable having a cable core, a cable jacket and a tear thread between the core and the jacket, said method comprising the steps of providing a cable core and arranging at least one tear thread on the core, arranging at least one auxiliary thread in order to fix the tear threads in position, and then providing a cable jacket to surround the cable core, the tear thread and the auxiliary thread, wherein the at least one auxiliary thread has a lower resistance to tearing than the at least one tear thread.

6. A method for manufacturing a cable having a cable core, a cable jacket and a tear thread between the core and the jacket, said method comprising the steps of providing a cable core and arranging at least one tear thread on the core, arranging a plurality of auxiliary threads in order to fix the tear threads in position, and then providing a cable jacket to surround the cable core, the tear thread and the auxiliary thread, wherein arranging the at least one tear thread comprises partially wrapping the tear threads with the auxiliary thread including braiding the auxiliary thread and tear thread.

7. A cable comprising a cable core, a cable jacket surrounding the core, means for facilitating stripping of the jacket from the core comprising at least one tear thread located between the core and jacket and means for fixing the position of the tear thread comprising at least one auxiliary thread positioned between the jacket and core and engaging the at least one tear thread, wherein the at least one auxiliary thread has a thickness less than the at least one tear thread.

8. A cable according to claim 2, wherein a plurality of tear threads are provided.

9. A cable according to claim 8, wherein the tear threads are equidistantly arranged around the cable core.

10. A cable according to claim 9, wherein the tear threads are wrapped by one or more auxiliary threads.

11. A cable according to claim 3, wherein the tear threads are part of a braid or weave and extend parallel to the longitudinal axis of the cable.

12. A cable according to claim 2, wherein two tear threads are wrapped by at least one auxiliary thread.

13. A cable according to claim 2, wherein the tear thread is wrapped by said at least one auxiliary thread.

14. A cable according to claim 4, wherein the tear threads are part of the braid and extend parallel to the longitudinal axis of the cable.

15. A method according to claim 5, wherein the step of arranging at least one auxiliary thread arranges a plurality of auxiliary threads.

16. A method according to claim 15, wherein the step of arranging at least one auxiliary thread partially wraps the tear threads with the auxiliary thread.

17. A method according to claim 6, wherein two tear threads and at least two auxiliary threads are knitted around the cable core so that the tear threads extend parallel to the longitudinal axis of the cable and are fixed in position by the auxiliary threads being wrapped therearound.

18. A method according to claim 5, wherein the step of arranging the auxiliary thread partially wraps the tear thread with the auxiliary thread.

19. A method according to claim 5, wherein the step of arranging the tear thread and the auxiliary thread arranges these at the same time and braids the tear thread and auxiliary thread in a woven pattern.

20. A method according to claim 5, wherein the step of arranging tear threads arranges to tear threads and the step of arranging auxiliary threads arranges two auxiliary threads which are knitted together so that the tear threads extend parallel to the longitudinal axis of the cable and are fixed in position by the looping of the auxiliary threads onto the tear threads.

* * * * *